US008904741B2

(12) United States Patent
Smeets et al.

(10) Patent No.: US 8,904,741 B2
(45) Date of Patent: Dec. 9, 2014

(54) HYBRID ROPE

(75) Inventors: Paulus Johannes Hyacinthus Marie Smeets, Geulle (NL); Xavier Amils, Kortrijk (BE)

(73) Assignees: DSM IP Assets B.V., Heerlen (NL); NV Bekaert S.A., Zwevegem (BE)

( * ) Notice: Subject to any disclaimer, the term of this patent is extended or adjusted under 35 U.S.C. 154(b) by 90 days.

(21) Appl. No.: 13/702,775

(22) PCT Filed: Jun. 7, 2011

(86) PCT No.: PCT/EP2011/059411

§ 371 (c)(1),
(2), (4) Date: Feb. 19, 2013

(87) PCT Pub. No.: WO2011/154415

PCT Pub. Date: Dec. 15, 2011

(65) Prior Publication Data

US 2013/0205742 A1 Aug. 15, 2013

(30) Foreign Application Priority Data

Jun. 8, 2010 (EP) ..... 10165263

(51) Int. Cl.
*D07B 1/06* (2006.01)
*D07B 1/16* (2006.01)
*D07B 1/02* (2006.01)

(52) U.S. Cl.
CPC ..... *D07B 1/0686* (2013.01); *D07B 1/025* (2013.01); *D07B 1/165* (2013.01); *D07B 2201/2048* (2013.01); *D07B 2201/2056* (2013.01); *D07B 2201/2065* (2013.01); *D07B 2205/2003* (2013.01); *D07B 2205/2014* (2013.01); *D07B 2205/205* (2013.01)
USPC ..... 57/222

(58) Field of Classification Search
CPC ..... B66B 7/06; D07B 1/0686; D07B 1/165; D07B 1/025
USPC ..... 57/212, 222
See application file for complete search history.

(56) References Cited

U.S. PATENT DOCUMENTS

| | | | | |
|---|---|---|---|---|
| 4,034,547 | A * | 7/1977 | Loos | 57/211 |
| 4,120,145 | A * | 10/1978 | Chiappetta et al. | 57/221 |
| 4,887,422 | A | 12/1989 | Klees et al. | |
| 6,334,293 | B1 * | 1/2002 | Poethke et al. | 57/210 |
| 6,412,264 | B1 | 7/2002 | De Josez et al. | |
| 8,176,718 | B2 * | 5/2012 | Ridge et al. | 57/212 |
| 2010/0071340 | A1 | 3/2010 | Ridge et al. | |

FOREIGN PATENT DOCUMENTS

| | | | |
|---|---|---|---|
| CN | 1729335 | A | 2/2006 |
| CN | 101688359 | A | 3/2010 |
| DE | 88 16 004 | | 12/1989 |
| EP | 0 357 883 | | 3/1990 |
| ES | 2 203 293 | | 4/2004 |
| WO | WO 00/50687 | | 8/2000 |
| WO | 2004/055263 | A1 | 7/2004 |

OTHER PUBLICATIONS

International Search Report for PCT/EP2011/059411 mailed Nov. 9, 2011.

Karian, Harutun G., *Handbook of Polyproplylene and Polypropylene Composites*, ISBN 0-8247-4064-5, Subchapters 7.2.1, 7.2.2, 7.2.5 and 7.2.7 (2003).

* cited by examiner

*Primary Examiner* — Shaun R Hurley
(74) *Attorney, Agent, or Firm* — Nixon & Vanderhye P.C.

(57) ABSTRACT

The invention relates to a hybrid rope having a core containing high modulus polyethylene (HMPE) yarns surrounded by an outer layer containing steel wire strands, wherein the core is coated with a plastomer, the plastomer being a semi-crystalline copolymer of ethylene or propylene and one or more C2 to C12 α-olefin co-monomers and the plastomer having a density as measured according to ISO1183 of between 870 and 930 kg/m$^3$.

9 Claims, No Drawings

HYBRID ROPE

This application is the U.S. national phase of International Application No. PCT/EP2011/059411 filed 7 Jun. 2011 which designated the U.S. and claims priority to EP 10165263.4 filed 8 Jun. 2010, the entire contents of each of which are hereby incorporated by reference.

The invention relates to a hybrid rope having a core containing high modulus polyethylene (HMPE) yarns surrounded by an outer layer containing steel wire strands, and to a method for manufacturing thereof.

Hybrid ropes having a core containing synthetic or natural yarns, surrounded by an outer layer containing for example helically laid outer steel wire strands are known. Hybrid ropes aim at combining the best of both worlds, the world of synthetic yarns and the world of steel wire. An advantage of the hybrid rope in view of a fully synthetic fiber rope is that the rope is less sensible to mechanical disruptions. The hybrid rope is more resistant to wear and to attack by sharp objects. Furthermore the outer layer protects the synthetic yarns of the core against external influences, like for example UV attack and to high temperature radiation.

Hybrid ropes are for example described in GB-1290900, U.S. Pat. No. 4,887,422 and WO 2008/141623. WO00/17441 describes a rope having a core formed by a bundle of parallel synthetic fibers covered by a thermoplastic sheath that serves as a winding support for the metal strands.

An advantage of the hybrid rope in view of a full steel wire rope is the lower weight of the rope and improved performance like e.g. tension- and bending fatigue. When high performance yarns, such as HMPE yarns are used in the core of the hybrid rope, the hybrid rope will show comparable or even higher performance and strength than a full steel wire rope with the same diameter, but the hybrid rope will have a considerable lower weight.

Hybrid ropes may for example be used in hoisting operations, for example as crane cables, in deep see installation, marine and off-shore mooring, commercial fishing, for example as warp lines for nets, and in mining operations.

It is believed that the performance of these known hybrid ropes can still be improved.

The invention therefore provides a hybrid rope having a core containing high modulus polyethylene (HMPE) yarns surrounded by an outer layer containing steel wire strands, wherein the core is coated with a plastomer, the plastomer being a semi-crystalline copolymer of ethylene or propylene and one or more C2 to C12 α-olefin co-monomers and wherein said plastomer has a density as measured according to ISO1183 of between 870 and 930 kg/m$^3$.

The advantage of using HMPE in the rope over other synthetic high performance fibers is that HMPE exceeds other fibers in terms of properties like tension fatigue, bending fatigue and stiffness and HMPE has the best match with steel wire.

The advantage of using the above-mentioned plastomer in the manufacture of this hybrid rope is that the plastomer has a processing temperature such that the mechanical properties of the HMPE core are not adversely effected by the processing conditions. Furthermore, since the plastomer is also based on polyolefin a good adhesion between the plastomer and HMPE core results. Also a uniform layer thickness of the coating can be obtained, ensuring a better closing of the steel wire around the core.

Using the coating of the plastomer of the invention on the HMPE core in the hybrid rope also ensures that the HMPE core is protected against abrasion due to the movement of the steel wire strands when the rope is in use. Less slippage occurs between the core and the steel outer layer.

An elastic modulus of the full hybrid rope close to the elastic modulus of a full steel rope can be obtained.

The plastomer used in the invention is a plastic material that belongs to the class of thermoplastic materials. According to the invention, said plastomer is a semi-crystalline copolymer of ethylene or propylene and one or more C2 to C12 α-olefin co-monomers, said plastomer having a density of between 870 and 930 kg/m$^3$. Preferably, the plastomer is manufactured by a single site catalyst polymerization process, wherein in particular said plastomer is a metallocene plastomer, i.e. a plastomer manufactured by a metallocene single site catalyst. Ethylene is in particular the preferred co-monomer in copolymers of propylene while butene, hexene and octene are being among the preferred α-olefin co-monomers for both ethylene and propylene copolymers.

In a preferred embodiment, the plastomer is a thermoplastic copolymer of ethylene or propylene and containing as co-monomers one or more α-olefins having 2-12 C-atoms, in particular ethylene, isobutene, 1-butene, 1-hexene, 4-methyl-1-pentene and 1-octene. When ethylene with one or more C2 to C12 α-olefin monomers as co-monomers is applied, the amount of co-monomer in the copolymer usually is lying between 1 en 50 wt. %, and preferably between 5 and 35 wt. %. In case of ethylene copolymers, the preferred co-monomer is 1-octene, said co-monomer being in an amount of between 5 wt % and 25 wt %, more preferably between 15 wt % and 20 wt %. In case of propylene copolymers, the amount of co-monomers and in particular of ethylene co-monomers, usually lies between 1 en 50 wt. %, and preferably between 2 and 35 wt %, more preferably between 5 and 20 wt. %. Good results were obtained when the density of the plastomer is between 880 and 920 kg/m$^3$, more preferably between 880 and 910 kg/m$^3$.

The plastomer used in the invention has a good process ability when it has a DSC peak melting point as measured according to ASTM D3418 of between 70° C. and 120° C., preferably between 75° C. and 100° C., more preferably between 80° C. and 95° C.

A plastomer manufactured by a single site catalyst polymerization process and in particular a metallocene plastomer is distinguished from ethylene and propylene copolymers that have been manufactured with other polymerization techniques, e.g. Ziegler-Natta catalysation, by its specific density. Said plastomer also differentiates itself by a narrow molecular weight distribution, Mw/Mn, the values thereof preferably being between 1.5 en 3 and by a limited amount of long chain branching. The number of long chain branches preferably amounts at most 3 per 1000 C-atoms. Suitable plastomers that may be used in the invention and obtained with the metallocene catalyst type are manufactured on a commercial scale, e.g by Exxon, Mitsui, DEX-Plastomers and DOW under brand names as Exact, Tafmer, Exceed, Engage, Affinity, Vistamaxx and Versify.

A description of plastomers and in particular of metallocene plastomers as well as an overview of their mechanical and physical properties can be found for instance in Chapter 7.2 of "*Handbook of polypropylene and polypropylene composites*" edited by Harutun G. Karian (ISBN 0-8247-4064-5) and more in particular in subchapters 7.2.1; 7.2.2; and 7.2.5 to 7.2.7 thereof, which are included herein by reference.

The plastomer used in the invention may also contain various fillers and additives added thereof. Examples of fillers include reinforcing and non-reinforcing materials, e.g. carbon black, calcium carbonate, clay, silica, mica, talc, and glass. Examples of additives include stabilizers, e.g. UV stabilizers, pigments, antioxidants, flame retardants and the like. Preferred flame retardants include aluminum tryhidrate, magnesium dehydrate and ammonium phosphate. The amount of flame retardants is preferably from 1 to 60, more preferably from 1 to 10 by weight percent of the amount of plastomer in the flexible sheet of the invention. Most preferred flame retardant is ammonium phosphate, e.g. Exolit.

In the following the coating on the rope is described as a single layer on the core containing HMPE yarns. However, the rope of the invention may also include further coatings, e.g. between the plastomer coating and the HMPE yarns, or between the plastomer coating and the steel wires.

As described above the core of the hybrid rope of the invention contains high modulus polyethylene (HMPE) yarns. Such yarns further contain HMPE fibers. By fiber is herein understood an elongate body, the length dimension of which is much greater that the transverse dimensions of width and thickness. Accordingly, the term fiber includes filament, ribbon, strip, band, tape, and the like having regular or irregular cross-sections. The fibers may have continuous lengths, known in the art as filaments, or discontinuous lengths, known in the art as staple fibers. Staple fibers are commonly obtained by cutting or stretch-breaking filaments. A yarn for the purpose of the invention is an elongated body containing many fibers.

Preferred polyethylene fibers are fibers made of high molecular weight polyethylene (HMWPE) and ultrahigh molecular weight polyethylene (UHMWPE). Said polyethylene fibers may be manufactured by any technique known in the art, preferably by a melt or a gel spinning process If a melt spinning process is used to manufacture the HMPE fibers, the polyethylene starting material used for manufacturing thereof preferably has a weight-average molecular weight between 20,000 and 600,000, more preferably between 60,000 and 200,000. An example of a melt spinning process is disclosed in EP 1,350,868 incorporated herein by reference.

Best results are obtained if a yarn of gel spun fibers of high or ultra high molecular weight polyolefin, preferably HMwPE or UHMwPE, is used in the core of the hybrid rope, e.g. those sold by DSM Dyneema under the name Dyneema®.

The gel spinning process is described in for example GB-A-2042414, GB-A-2051667, EP 0205960 A and WO 01/73173 A1. This process essentially comprises the preparation of a solution of a polyolefin of high intrinsic viscosity, spinning the solution to filaments at a temperature above the dissolving temperature, cooling down the filaments below the gelling temperature so that gelling occurs and drawing the filaments before, during or after removal of the solvent.

The shape of the cross-section of the filaments may be selected here through selection of the shape of the spinning aperture.

Preferably HMwPE is used with an intrinsic viscosity of at least 3 dl/g, determined in decalin at 135° C., more preferably at least 4 dl/g, most preferably at least 5 dl/g. Preferably the IV is at most 40 dl/g, more preferably at most 25 dl/g, more preferably at most 15 dl/g.

The intrinsic viscosity is determined according to PTC-179 (Hercules Inc. Rev. Apr. 29, 1982) at 135° C., the dissolution time being 16 hours, the anti-oxidant is DPBC, in an amount of 2 g/l solution, and the viscosity is measured at different and is extrapolated to zero concentration.

Preferably, the UHMWPE has less than 1 side chain per 100 C atoms, more preferably less than 1 side chain per 300 C atoms.

Preferably, the polyethylene fibers have deniers per filament in the range of from 0.1 to 50, more preferably from 0.5 to 20, most preferably from 1 to 10 dpf. The polyethylene yarns preferably are preferably from 200 to 50,000, more preferably from 500 to 10,000, most preferably from 800 to 4800 denier.

The tensile strength of the polyethylene fibers utilized in the present invention as measured according to ASTM D2256 is preferably at least 1.2 GPa, more preferably at least 2.5 GPa, most preferably at least 3.5 GPa. The tensile modulus of the polyethylene fibers as measured according to ASTM D2256 is preferably at least 30 GPa, more preferably at least 50 GPa, most preferably at least 60 GPa.

Other fibers that may be used in combination with the polyethylene fibers to construct the core of the hybrid rope of the invention include but are not limited to fibers manufactured from polyamides and polyaramides, e.g. poly(p-phenylene terephthalamide) (known as Kevlar®); poly(tetrafluoroethylene) (PTFE); aromatic copolyamid (co-poly-(paraphenylene/3,4'-oxydiphenylene terephthalamide)) (known as Technora®); poly{2,6-diimidazo-[4,5b-4',5'e]pyridinylene-1,4(2,5-dihydroxy)phenylene} (known as M5); poly(p-phenylene-2,6-benzobisoxazole) (PBO) (known as Zylon®); poly(hexamethyleneadipamide) (known as nylon 6,6), poly(4-aminobutyric acid) (known as nylon 6); polyesters, e.g. poly(ethylene terephthalate), poly(butylene terephthalate), and poly(1,4 cyclohexylidene dimethylene terephthalate); polyvinyl alcohols; thermotropic liquid crystal polymers (LCP) as known from e.g. U.S. Pat. No. 4,384,016; but also polyolefins other than polyethylene e.g. homopolymers and copolymers of polypropylene. Also combinations of fibers manufactured from the above referred polymers can be used in the rope of the invention. Preferred other fibers however are fibers of polyaramides and/or LCP.

In order to fully have the advantage of the use of the plastomer coating on the core containing HMPE yarns, it is preferred that the core contains at least 60 wt %, based of the total weight of the core, of HMPE yarns. More preferably the core contains at least 70 wt.% of even at least 80 wt.% HMPE yarns. The remaining weight of the core may consist of yarns manufactured from other polymers as enumerated hereinabove.

Before applying the coating of plastomer on the core, the core may be coated by other coatings known in the art. Such coatings can, as an example, comprise polyurethane, silicone oil, bitumen or combinations thereof. An example of a suitable coating is ICO-N-Dure from I-Coats. The rope may contain this coating of 2.5-35 wt % in a dried state. In particular, the rope contains 10-25 wt % of such a non-plastomer coating.

It is also possible to use HMPE yarns that have a coating applied thereon to make the core. Such coatings comprise overlay finishes known in the art, which can also be polyurethane, silicone, cross-linked silicone, etc.

The core containing HMPE yarns is preferably a rope made of HMPE yarns. The core may have any construction known for synthetic ropes. The core may have a plaited, a braided, a laid, a twisted or a parallel construction, or combinations thereof. Preferably the core has a laid or a braided construction, or a combination thereof.

In such rope constructions, the ropes are made up of strands. The strands are made up of rope yarns, which contain synthetic fibers. Methods of forming yarns from fiber, strands from yarn and ropes from strands are known in the art.

In embodiments comprising a mixture of HMPE fibers and further synthetic fibers as described above, the mixture of the fibers may be at all levels. The mixture may be at rope yarns made from fibers, at strands made from rope yarns, and/or at the final rope made from strands.

The number of strands in the core rope may also vary widely, but is generally at least 3 and preferably at most 16, to arrive at a combination of good performance and ease of manufacture.

When the core rope is a braided rope, there is a variety of braid types known, each generally distinguished by the method that forms the rope. Suitable constructions include soutache braids, tubular braids, and flat braids. Tubular or circular braids are the most common braids for rope applications and generally consist of two sets of strands that are intertwined, with different patterns possible. The number of strands in a tubular braid may vary widely. Especially if the number of strands is high, and/or if the strands are relatively thin, the tubular braid may have a hollow core; and the braid may collapse into an oblong shape. To improve shape stability it can be considered to include a rod, or a rod-like shape, in the centre of the core. This rod can be made of other polymers, but is preferably made of polypropylene or polyethylene, in particular HMPE.

The number of strands in a braided core rope according to the invention is preferably at least 3. An increasing number of strands tends to lower the strength efficiency of the rope. The number of strands is therefore preferably at most 16, depending on the type of braid. Particularly suitable are ropes of an 8- or 12-strand plaited or braided construction. Such core ropes provide a favourable combination of tenacity and resistance to bend fatigue, and can be made economically on relatively simple machines.

The core rope used in the hybrid rope according to the invention can be of a construction wherein the lay length (the length of one helix of a strand in a laid construction) or the braiding period (that is the length of one helix of a strand in a plaited or braided rope) is adapted to the outer steel wire strands to assure a mutual tension sharing over the working area of a rope and also at break to failure.

Suitable braiding periods are in the range of from 4 to 20. A higher braiding period may result in a more loose rope having higher strength efficiency, but which is less robust and more difficult to splice. Too low a braiding period would reduce tenacity too much. Preferably therefore, the braiding period is about 5-15, more preferably 6-10. In all cases the lay length or braiding period can be adapted to the steel wire type and construction in such a way that both products work best together with respect to load sharing (strength) and/or fatigue performance in the working area of the rope and the break to failure.

In the rope according to the invention the construction of the strands, also referred to as primary strands, is not specifically critical. The skilled person can select suitable constructions like laid or braided strands, and twist factor or braiding period respectively, such that a balanced and torque-free rope results and an optimum cooperation with the outer steel wire strands is achieved with regard to load sharing.

The core containing synthetic yarns for the hybrid rope of the invention, can have any known thickness, depending on the ultimate use of the hybrid rope. Generally the core will have a diameter from 1 mm to 300 mm. Preferably the core has a diameter from 5 mm to 200 mm.

The core containing HMPE yarns of the invention can be "heat-set". This means that the method of manufacturing the core can also comprise a step of post-stretching the primary strands before constructing the rope, or alternatively a step of post-stretching the rope. Such stretching step is preferably performed at elevated temperature but below the melting point of the (lowest melting) filaments in the stands (also called heat-stretching or heat-setting); preferably at temperatures in the range 80-150° C. Such a post-stretching step is described in. EP 398843 B1 or U.S. Pat. No. 5,901,632. Heat setting can be performed both before and after application of the coating on the core.

The rope of the invention can be coated with the plastomer by methods known in the art. For example the rope of the invention can be coated with the plastomer by known extrusion-coating processes, also known as jacket-extrusion, where the rope is extruded together with the molten plastomer through a die and then cooled below the melting temperature of the plastomer.

The temperature in the extruder to process the plastomer is from 70 to 200° C. Too low a temperature will result in the plastomer not melting properly, too high a temperature may result in decomposition of the plastomer. The skilled person will be able to determine the optimal temperature based on the material and equipment used.

The plastomer coating can be deposited on the exterior of the rope of the invention as a layer having an average thickness of at least 0.1 mm, more preferably at least 0.5 mm. Preferably said thickness is at most 20 mm, more preferably at most 15 mm. The average thickness can be measured with methods known in the art, e.g. with an optical microscope on cross-section of said rope and averaging at least 10 measurements. It is preferred that the layer of plastomer coats substantially the whole surface of the core, i.e. the layer of plastomer coats the entire core, but for instance both ends of the rope can be left uncoated.

The outer layer of the rope may contain any steel wire known for producing steel ropes may be used. Preferably, the steel wires are plain high-carbon steel wires. A high-carbon steel may have a composition along following lines: a carbon content ranging from 0.30% to 1.15%, preferably between 0.40% and 0.90%, a manganese content ranging from 0.10% and 1.10%, a silicon content ranging from 0.10% to 0.90%, the sulfur and phosphorous contents being limited to 0.15%, preferably to 0.10% or even lower. Additional micro-alloying elements such as chromium (up to 0.20%-0.40%), copper (up to 0.20%) and vanadium (up to 0.30%) may be added. All percentages are percentages by weight.

The individual steel wires may or may not be coated with a coating such as a corrosion resistant coating, e.g. a zinc coating or a zinc aluminum coating, or a zinc aluminum magnesium coating.

The individual steel wires are twisted into several strands. Dependent upon the final application, the diameter of the individual steel wires may vary between 0.30 mm and 7.0 mm.

Preferably the outer layer of the rope contains one layer of helically laid steel wire strands around the core, but two layers of steel strands are not excluded.

It is possible that the outer layer of the rope contains more than one layer of strands that are helically laid around the core. Preferably such layers are twisted in opposite direction from the adjacent layer or layers.

The inventions is particular suitable for hybrid ropes of all kind of diameters. For hoisting operations preferably rope of a diameter between 10 and 60 mm are used. For deep see installation and marine and off shore mooring the diameter preferably is between 40 and 200 mm.

It was observed that a rope according to this embodiment presents a useful efficiency as well as a proper dimensional stability. It was also observed that a rope according to this embodiment is a suitable candidate for high load applications, i.e. application wherein high loads are manipulated or fixated.

The present invention also relates to a method for making a hybrid rope, comprising the steps of:

(a) constructing a core containing high modulus polyethylene (HMPE) yarns (b) coating the core with a plastomer, the plastomer being a semi-crystalline copolymer of ethylene or propylene and one or more C2 to C12 α-olefin co-monomers and wherein said plastomer has a density as measured according to ISO1183 of between 870 and 930 kg/m$^3$; obtaining a coated core; and (c) applying an outer layer containing steel wire strands around the coated core obtained in step (b).

The method may include a step where a further cover or sheath is applied around the core containing HMPE yarns prior to applying the plastomer. Said sheath or cover may be manufactured from the fibers or combination of fibers as described above and may be braided or laid.

The method may further include a step wherein after step (a) or step (b) the core is post-stretched at an elevated temperature.

According to a further aspect, the invention relates to a rope containing high modulus polyethylene (HMPE) yarns wherein the rope is coated with a plastomer, the plastomer being a semi-crystalline copolymer of ethylene or propylene and one or more C2 to C12 α-olefin co-monomers and the plastomer having a density as measured according to ISO1183 of between 870 and 930 kg/m$^3$ According to an alternative embodiment, the HMPE yarns of the core are impregnated with the plastomer. The invention thus also relates to a hybrid rope having a core containing high modulus polyethylene (HMPE) yarns containing HMPE fibers surrounded by an outer layer containing steel wire strands, the HMPE fibers being impregnated with a plastomer deposited between and around the fibers, the plastomer being a semi-crystalline copolymer of ethylene or propylene and one or more C2 to C12 α-olefin co-monomers and the plastomer having a density as measured according to ISO1183 of between 870 and 930 kg/m$^3$.

The core containing HMPE yarns with a plastomer deposited thereon, may be further coated, by a coating of the plastomer, as described above, on the outside of the core.

For an efficient impregnation of the core it is desirable that the plastomer is deposited between and around the fibers of the rope. This may be achieved for example by guiding the fibers through a bath containing a solution or a dispersion of the plastomer in a suitable solvent. A more preferred impregnation method is by using pressure and temperature to force the molten plastomer into the rope as exemplified in GB 1,296,339 included herein by reference. It has been suggested therein to make use of a pressure impregnation, wherein the rope is moved through a treating chamber to which an impregnation agent, e.g. the plastomer, is supplied under pressure. Also the plastomer can be introduced during production of the rope so that the plastomer is well distributed and will impregnate homogeneously during melting.

A further preferred impregnation method comprises the steps:

(i) providing fibers, tapes or shreds of the plastomer obtained by splitting or shredding a plastomer film;

(ii) mixing said fibers, tapes or shreds of plastomer with the polyethylene fibers and forming strands thereof;

(iii) forming a rope from the strands obtained at step (ii); and (iv) heating the rope of step (iii) at a temperature between the melting temperature of the plastomer and the melting temperature of the polyethylene fibers while stretching the rope.

Further preferred embodiments of the rope and the plastomer are as described above for the core of the hybrid rope.

The advantageous construction of the hybrid rope of the invention makes it particularly useful for hoisting operations, for example as crane cables, in deep see installation, marine and off-shore mooring, commercial fishing, for example as warp lines for nets, and in mining operations.

Example 1

First the core of HMPE yarn was produced. In a first step a 12 strand braided first core part was produced, each strand consisting of 8*1760 dTex Dyneema® SK78 yarn. The first core part has a diameter of 6.5 mm. This first core part is overbraided with 12 strands of 4*1760 dTex Dyneema® yarn. The total diameter of the so obtained core is 8 mm.

In a next step a coating of a plastomer EXACT™ 0230 was extruded on the core as manufactured above using a Collie™ 45 mm single screw extruder with the following processing conditions:

| Extruder Settings | Units | |
|---|---|---|
| Barrel 1 | | 80 |
| Barrel 2 | [° C.] | 172 |
| Barrel 3 | [° C.] | 172 |
| Barrel 4 | [° C.] | 175 |
| Barrel 5 | [° C.] | 175 |
| Neck | [° C.] | 175 |
| Head | [° C.] | 181 |
| Tip | [° C.] | 186 |
| Melt temperature | [° C.] | 170 |
| Head pressure | [bar] | 22 |
| Screw speed | [rpm] | 21 |
| Power | [A] | 7.9 |
| Outer diameter tip | [mm] | |
| Inner diameter tip | [mm] | 6.6 |
| Diameter die | [mm] | 9.5 |
| Vacuum on cable head | | yes |
| Line speed | [m/min] | 6.6 |

The hybrid rope is thereafter obtained by first twisting eight strands of each 19 bright, i.e. non coated steel wires and compacting them and thereafter closing these eight compacted strand around the core, which forms thereafter the core of the hybrid rope. The tensile strength of the steel wires is 1960 MPa.

Comparative Example 1

A steel wire with sisal core was manufactured as follows. The core was first produced by twisting sisal yarns forming sisal strands. Later, 3 outer sisal strands and 1 central sisal strand were cabled or, alternatively only, 3 central strands. The rope is thereafter obtained by first twisting eight compacted strands of each 19 bright, i.e. non coated steel wires and thereafter closing these eight compacted strand around the sisal core, which forms thereafter the core of the rope. The tensile strength of the steel wires is 1960 MPa.

Comparative Example 2

A steel wire rope with steel core was manufactured as follows. An independent wire rope core (IWRC) with 7×7 construction, was first produced by stranding 1+6 strands. The rope is thereafter obtained by first twisting eight outer compacted strands of each 19 bright, i.e. non coated steel wires and thereafter closing these eight compacted strands around the IWRC. The tensile strength of the steel wires is 1960 MPa.

All ropes as described in the examples above were tested for their breaking strength according to the following protocol:

The ropes were breaking load tested in a breaking load testing machine. The ropes were fixed to the machine by steel clamps properly designed for such purpose. The elongation of the samples was measured by means of extensiometer at least at 5.000, 10.000, 25.000 and 50.000 N (eventually also 75.000 N). Loading points were chosen to perform sequential cycling down to circa 1.000 N before finally breaking the samples; the slope of the final cycling up to 50,000 N (eventually also 75.000 N) can be used for elastic modulus evaluation.

| | Breaking strength (kN) |
|---|---|
| Example 1 | 146 |
| Comparative Example 1 | 113 |
| Comparative Example 2 | 137 |

The invention claimed is:

1. A hybrid rope having a core containing high modulus polyethylene (HMPE) yarns surrounded by an outer layer containing steel wire strands, wherein the core is coated with a plastomer, the plastomer being a semi-crystalline copolymer of ethylene or propylene and one or more C2 to C12 α-olefin co-monomers and the plastomer having a density as measured according to ISO1183 of between 870 and 930 kg/m$^3$.

2. The hybrid rope according to claim 1 wherein the plastomer is manufactured by a single site catalyst polymerization process.

3. The hybrid rope according to claim 1 wherein the plastomer is a thermoplastic copolymer of ethylene or propylene and contains as co-monomers one or more α-olefins having 2-12 C-atoms.

4. The hybrid rope according to claim 1 wherein the plastomer has a density of between 880 and 910 kg/m$^3$.

5. The hybrid rope according to claim 1 wherein the plastomer has a peak melting point of between 70° C. and 120° C.

6. The hybrid rope according to claim 1 wherein the HMPE yarns contain fibers which are gel spun fibers of ultrahigh molecular weight polyethylene (UHMWPE).

7. The hybrid rope according to claim 1, wherein the HMPE yarns contain fibers of HMWPE having an intrinsic viscosity of at least 3 dl/g determined in decalin at 135° C.

8. The hybrid rope according to claim 1, wherein the HMPE yarns contain fibers having a tensile modules of at least 30 GPa.

9. The hybrid rope according to claim 1 wherein the core is a braided or laid rope.

* * * * *